US008800312B2

(12) United States Patent
Ueda et al.

(10) Patent No.: US 8,800,312 B2
(45) Date of Patent: Aug. 12, 2014

(54) REFRIGERATOR

(75) Inventors: Yoshihiro Ueda, Nara (JP); Satomi Ueda, legal representative, Nara (JP); Toyoshi Kamisako, Shiga (JP); Kenichi Kakita, Shiga (JP); Kumiko Okubo, Shiga (JP); Mitoko Ishita, Shiga (JP)

(73) Assignee: Panasonic Corporation, Osaka (JP)

( * ) Notice: Subject to any disclaimer, the term of this patent is extended or adjusted under 35 U.S.C. 154(b) by 171 days.

(21) Appl. No.: 13/389,547

(22) PCT Filed: Aug. 26, 2010

(86) PCT No.: PCT/JP2010/005250

§ 371 (c)(1),
(2), (4) Date: Feb. 22, 2012

(87) PCT Pub. No.: WO2011/024454

PCT Pub. Date: Mar. 3, 2011

(65) Prior Publication Data

US 2012/0137720 A1 Jun. 7, 2012

(30) Foreign Application Priority Data

Aug. 26, 2009 (JP) ..... 2009-194951
Aug. 26, 2009 (JP) ..... 2009-194952

(51) Int. Cl.
*F25D 23/00* (2006.01)

(52) U.S. Cl.
USPC ..... 62/264; 62/407

(58) Field of Classification Search
CPC ..... F25D 17/042; F25D 2317/043; F25D 2317/0413; F25D 17/065; F25D 2317/067
USPC ..... 62/407, 373, 419, 440, 264; 239/289, 239/691
See application file for complete search history.

(56) References Cited

U.S. PATENT DOCUMENTS

| | | | | |
|---|---|---|---|---|
| 4,358,935 | A * | 11/1982 | Losert et al. | 62/188 |
| 7,966,842 | B2 | 6/2011 | Kamisako et al. | |
| 2010/0024462 | A1 | 2/2010 | Kamisako et al. | |
| 2010/0077770 | A1 | 4/2010 | Kamisako et al. | |
| 2010/0077791 | A1 | 4/2010 | Kamisako et al. | |

FOREIGN PATENT DOCUMENTS

| | | |
|---|---|---|
| JP | 2004-125179 | 4/2004 |
| JP | 2005-207690 | 8/2005 |
| JP | 2005-337694 | 12/2005 |
| JP | 2007-147101 | 6/2007 |

(Continued)

OTHER PUBLICATIONS

Abstrat of JP 2008-39315 to Tsujimoto et al.*

(Continued)

*Primary Examiner* — Mohammad M Ali
(74) *Attorney, Agent, or Firm* — Hamre, Schumann, Mueller & Larson, P.C.

(57) ABSTRACT

In a storage compartment (124), storage spaces having different mist concentrations are formed such that effects of a mist is more efficiently utilized to provide a refrigerator with improved usability. The storage compartment (124) includes a first storage unit (164) that has a high mist concentration. The first storage unit (164) includes a spray device (167) and is disposed in a position outside an air path of cool air between a discharge port (152) through which the cool air flows in from outside the storage compartment (124) and a suction port (149) through which the cool air is discharged to outside the storage compartment (124). Thus, mist concentration inside the first storage unit (164) can be increased.

12 Claims, 7 Drawing Sheets

(56) References Cited

FOREIGN PATENT DOCUMENTS

| | | | |
|---|---|---|---|
| JP | 2008-39315 | * | 2/2008 |
| JP | 2008-089282 | | 4/2008 |
| JP | 2008-101817 | * | 5/2008 |
| JP | 2009-180447 | | 8/2009 |
| WO | 2006/009190 | | 1/2006 |
| WO | 2008/139704 | | 11/2008 |

OTHER PUBLICATIONS

Translation of JP 2008-39315 to Tsujimoto et al.*
Abstract of JP 2008-101817 to Tsujimoto et al.*
Translation of JP 2008-101817 to Tsujimoto et al.*

* cited by examiner

REFRIGERATOR

TECHNICAL FIELD

The present invention relates to refrigerators, and particularly to a refrigerator including a spray device which sprays a mist to a particular portion in the refrigerator.

BACKGROUND ART

Some of the factors that cause loss of freshness of a vegetable, which is an example of produce, are temperature, humidity, environmental gas, microorganisms, and light. Respiration and transpiration of vegetables continue even after harvest. To preserve freshness of vegetables, respiration and transpiration need to be suppressed. In many vegetables, except some which are susceptible to low temperature damage or the like, the respiration is suppressed in low temperature and the transpiration can be prevented by high humidity.

In recent years, to preserve freshness of vegetables, some of household refrigerators include a sealed vegetable container and are controlled such that vegetables are cooled to a proper temperature and humidity in the vegetable container is increased to suppress transpiration by the vegetables. Furthermore, some refrigerators employ a mist spray unit to achieve high humidity in the vegetable container.

Conventionally, this type of refrigerator having a mist spray function generates and sprays a mist by vibrating a hygroscopic material using an ultrasonic oscillator. With the mist, inside of a vegetable compartment is humidified to suppress the transpiration by vegetables (for example, see Patent Literature (PTL) 1).

FIG. 6 and FIG. 7 show the conventional refrigerator described in PTL 1.

As shown in FIG. 6, the refrigerator includes a vegetable compartment 4 that is of a drawer type. A refrigerator compartment 2 and the vegetable compartment 4 are partitioned by a partition plate 8. The partition plate 8 includes a hole 9 that is for allowing cool air to flow into the vegetable compartment 4 from the refrigerator compartment 2. To the vegetable compartment 4, a vegetable container 10 is provided. The vegetable container 10 moves with the vegetable compartment 4. Furthermore, disposed on the top part of the vegetable container 10 is a vegetable container lid 11 that closes the vegetable container 10 in a state where the vegetable compartment 4 is pushed in. The vegetable container lid 11 includes an ultrasonic humidification unit 12 with which water is sprayed into the vegetable container 10.

Furthermore, as shown in FIG. 7, the ultrasonic humidification unit 12 is provided in a hole 15 of the vegetable container lid 11 and includes an water absorbent material 16 and an ultrasonic oscillator 17.

The following describes an operation of the refrigerator having the above-described structure.

When the temperatures in the refrigerator compartment 2 and the vegetable compartment 4 gets high, a refrigerant is provided to a cooler 13 and a fan 14 is driven. As a result, as indicated by arrows in FIG. 6, cool air around the cooler 13 flows through the refrigerator compartment 2, the hole 9, and the vegetable compartment 4 and then returns to the cooler 13. Thus, the refrigerator compartment 2 and the vegetable compartment 4 are cooled. This state is referred to as a cooling mode.

Then, when the cooling of the refrigerator compartment 2 and the vegetable compartment 4 is almost achieved, supply of the refrigerant to the cooler 13 is stopped. However, the fan 14 continues to operate. With this, frost adhering to the cooler 13 melts, and the refrigerator compartment 2 and the vegetable compartment 4 are humidified. This state is referred to as a humidification mode (the so-called "moisture operation").

After the humidification mode is continued for a predetermined time period (several minutes), the fan 14 is stopped to switch to an operation stop mode.

Subsequently, when the temperature in the refrigerator compartment 2 and the vegetable compartment 4 gets high, the refrigerator enters the cooling mode again.

The following describes the ultrasonic humidification unit 12.

The water absorbent material 16 is made of a water-absorbing material such as silica gel, zeolite, and activated carbon. Thus, during the above-mentioned humidification mode, the water absorbent material 16 adsorbs water contained in the flowing air. Then, the ultrasonic oscillator 17 is driven in the latter part of the cooling mode. This causes the water in the water absorbent material 16 to be discharged to the outside. With this, inside of the vegetable container 10 is humidified. Note that the driving of the ultrasonic oscillator 17 in the latter part of the cooling mode is intended to prevent the drying of stored items caused by a decrease in humidity in the vegetable compartment 4.

CITATION LIST

Patent Literature

[PTL 1]
Japanese Unexamined Patent Application Publication No. 2004-125179

SUMMARY OF INVENTION

Technical Problem

According to the above-described conventional structure, the upper surface of the vegetable container 10 is closed by the vegetable container lid 11, and a mist is sprayed with the ultrasonic oscillator 17 during the humidification mode (during the moisture operation). Thus, cool air containing moisture circulates in the vegetable compartment 4 only to spread throughout the vegetable container 10. Here, there is a problem that some produce prefer to be stored in a temperature range applied to the vegetable compartment and in a relatively low humidity environment.

The present invention solves the above-described conventional problem and has as an object to provide a refrigerator which can create, in a produce compartment, environments having different concentrations of mist according to the type of produce so that effects of the mist can be utilized more efficiently.

Solution to Problem

In order to solve the aforementioned problem, a refrigerator according to the present invention includes: a storage compartment which can be set to a temperature range suitable for storing produce; a first storage unit and a second storage unit which are provided in the storage compartment; and a spray device which sprays a mist into the first storage unit so that the first storage unit has a higher mist concentration than the second storage unit.

Thus, a space having a high mist concentration can be created in a part of the produce compartment. With this, it is possible to select between a storage space where produce which prefers to be stored in high humidity or a storage space where other produce is stored. Thus, effects of mist can be utilized more efficiently and freshness of produce can be preserved.

Advantageous Effects of Invention

According to the present invention, effects of mist can be utilized efficiently in a produce compartment, and thus it is possible to provide a refrigerator that is more convenient to use.

DESCRIPTION OF EMBODIMENTS

Figure 1:
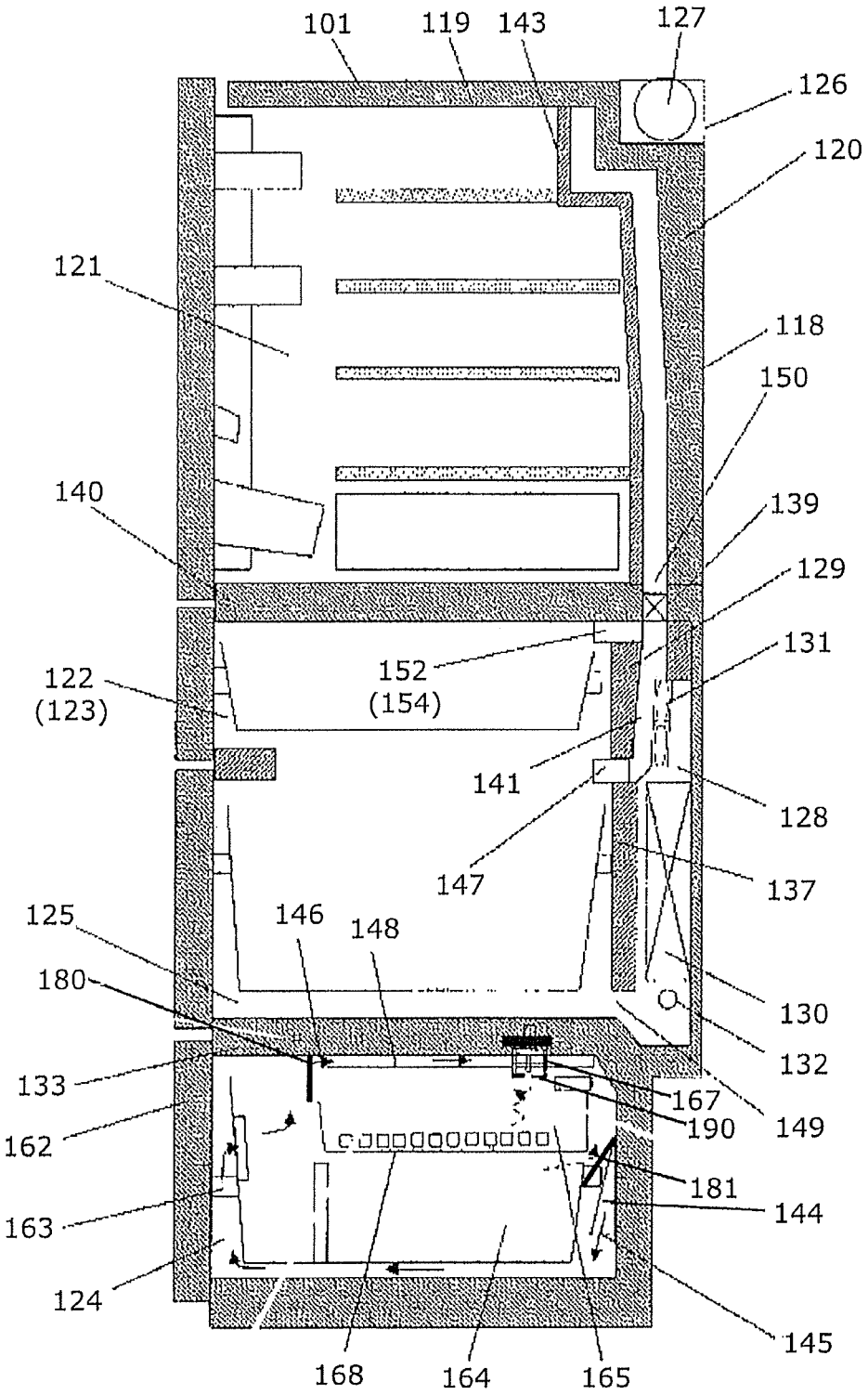
FIG. 1 is a longitudinal sectional view of a refrigerator according to Embodiment 1 of the present invention.

According to a first aspect of the present invention is a refrigerator which includes: a storage compartment which can be set to a temperature range suitable for storing produce; a first storage unit and a second storage unit which are provided in the storage compartment; and a spray device which sprays a mist into the first storage unit so that the first storage unit has a higher mist concentration than the second storage unit.

With this, the mist concentration inside the first storage unit is maintained higher than the mist concentration inside the second storage unit. Thus, mist concentration suitable for the purpose of storage can be selected.

According to a second aspect of the present invention, a refrigerator may further includes a cooling compartment which includes a cooler that generates cool air, wherein the storage compartment includes: a discharge port through which the cool air is discharged into the storage compartment; and a suction port through which the cool air is returned to the cooling compartment, and the first storage unit is disposed outside an air path through which the cool air flows from the discharge port to the suction port.

With this, it is possible to prevent the mist inside the first storage unit from flowing out due to the flow of the cool air. Thus, the mist concentration inside the first storage unit can be kept high.

According to a third aspect of the present invention, it is preferable that the mist contain at least one of ozone and OH radicals.

With this, harmful substances adhering to the surfaces of produce are hydrophilized. Thus, when the produce that is taken out of the produce compartment is washed with water, the harmful substances can be rinsed off more easily.

According to a fourth aspect of the present invention, the first storage unit may be defined by a case that has a substantially sealed structure.

With this, it is possible to increase the mist concentration inside the case that forms the first storage unit. This makes it possible to more effectively preserve the freshness of the produce which prefers to be stored in high humidity. Furthermore, it becomes easier to rinse off harmful substances that are adhering to large parts of produce stored in the case.

According to a fifth aspect of the present invention, the spray device may be disposed on a centerline of the storage compartment in an up-down direction or above the centerline of the storage compartment in the up-down direction.

With this, utilizing the characteristic that cool air flows downwards, the mist generated by the spray device can be filled into the first storage unit from further above and thus the first storage unit can be filled with the mist. This makes it possible to more effectively preserve the freshness of the produce which prefers to be stored in high humidity. Furthermore, it becomes easier to rinse off harmful substances which are adhering to large parts of produce stored in the first storage unit.

According to a sixth aspect of the present invention, the case may include a sealer which is soft.

With this, the case can have a substantially sealed structure with a simple structure, and thus the mist concentration within the case can be increased. Therefore, it becomes possible to more effectively preserve the freshness of the produce which prefers to be stored in high humidity. Furthermore, it becomes easier to rinse off harmful substances that are adhering to large parts of produce stored in the first storage unit.

According to a seventh aspect of the present invention the case may have a shape of an open-topped box, and the refrigerator may further comprise a lid that covers the top of the case.

With this, the case can have a substantially sealed structure, and thus the mist concentration inside the case can be increased. Therefore, it becomes possible to more effectively preserve the freshness of the produce which prefers to be stored in high humidity. Furthermore, it becomes easier to rinse off harmful substances which are adhering to large parts of produce stored in the first storage unit.

The following describes embodiments of the present invention with reference to drawings. Note that the present invention is not limited to these embodiments.

Embodiment 1

FIG. 1 is a longitudinal sectional view of a refrigerator according to Embodiment 1 of the present invention.

Figure 2:
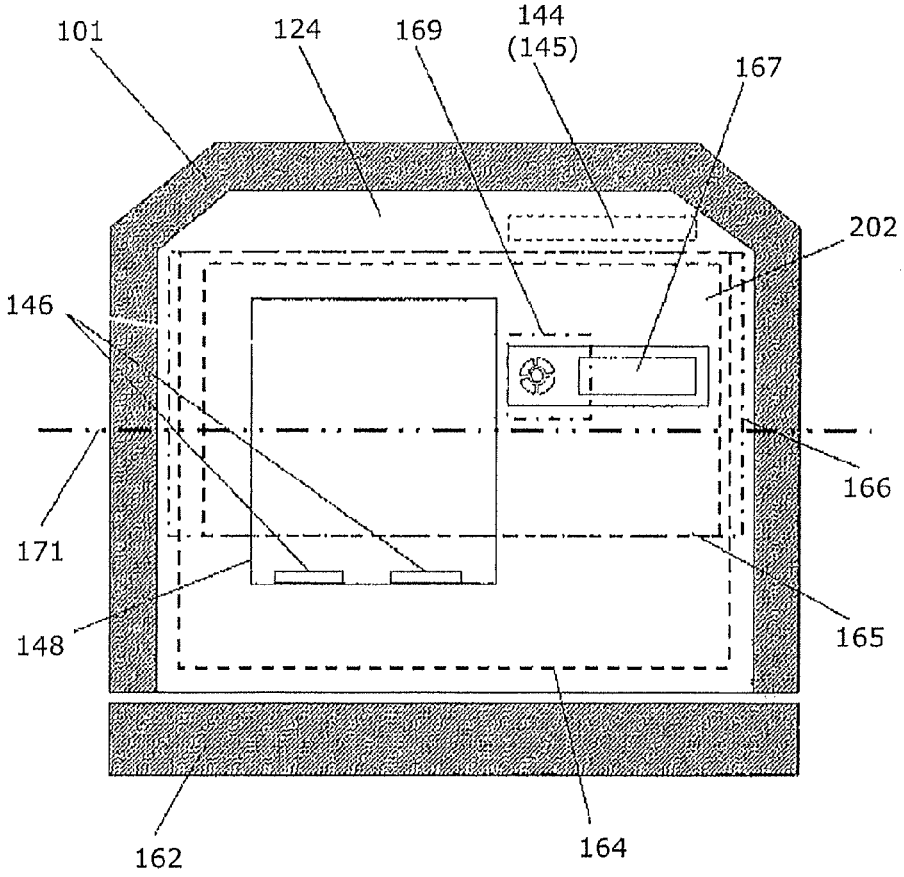
FIG. 2 is a detailed plan view of a produce compartment of the refrigerator according to Embodiment 1 of the present invention.

FIG. 2 is a detailed plan view of the refrigerator according to Embodiment 1 of the present invention.

As shown in FIG. 1 and FIG. 2, a main body of a refrigerator 101 includes an outer case 118 and an inner case 119. Between the outer case 118 and the inner case 119, a foam heat insulation material 120 such as rigid urethane foam is filled to provide heat insulation from the surroundings. Furthermore, inside of the inner case 119 is divided into a plurality of storage compartments. In the uppermost portion of the inner case 119, a refrigerator compartment 121 as a first storage compartment is provided. Below the refrigerator compartment 121, an upper freezer compartment 122 as a fourth storage compartment and an ice-making compartment 123 as a fifth storage compartment are arranged side by side. Below the upper freezer compartment 122 and the ice-making compartment 123, a lower freezer compartment 125 as a third storage compartment is provided. In the lowermost portion of the inner case 119, a produce compartment 124 as a second storage compartment which is for storing produce such as vegetables, fruit, beans, and grains is provided.

The refrigerator compartment 121 has, as a lowermost temperature, a temperature for cold storage that does not cause freezing, and is typically kept between 1 degree C. and 5 degrees C. Furthermore, the produce compartment 124 can be set to a temperature range that is the same or slightly higher than the temperature range of the refrigerator compartment 121, and is specifically set between 2 degrees C. and 7 degrees C. Note that, within the above-described temperature range, freshness of leafy vegetables can be preserved longer as the temperature decreases.

Furthermore, in the following description of the present invention according to this embodiment, the fourth storage compartment is not limited to the freezer compartment but may be a switch compartment. In addition to the temperature ranges of between: 1 degree C. and 5 degrees C. for cold storage; between 2 degrees C. and 7 degrees C. for vegetables; and typically between −22 degrees C. and −15 degrees C. for frozen storage, the switch compartment can be switched to a predetermined temperature range between the cold storage temperature range and the frozen storage temperature range. For example, the temperature range may be a range for soft freezing (generally between −12 degrees C. and −6 degrees C. or the like), a range for partial freezing (generally between −5 degrees C. and −1 degree C. or the like), and a range for chilled (generally between −1 degree C. and 1 degree C. or the like), that is, a temperature range between a cold storage and frozen storage.

The above-described switch compartment is a storage compartment which covers a temperature range from cold storage to frozen storage. However, it goes without saying that the switching compartment alternatively may be a storage compartment in which temperature range can be switched between soft freezing, partial freezing, and chilled or may be a storage compartment dedicated to one of the particular temperature ranges, leaving the cold storage to be handled by the refrigerator compartment 121 and the produce compartment 124 and the frozen storage to be handled by the lower freezer compartment 125.

Note that as long as the produce compartment 124 can be set to a temperature range of between 2 degrees C. and 7 degrees C., the produce compartment 124 may be settable to other temperature ranges such as below 2 degrees C. or over 8 degrees C.

Behind the upper freezer compartment 122, the ice-making compartment 123, and the lower freezer compartment 125, a cooling compartment 128 is provided. The cooling compartment 128 is partitioned into the upper freezer compartment 122, the ice-making compartment 123, and the lower freezer compartment 125 by a first cooling duct 129 having heat insulation properties. In the cooling compartment 128, a cooler 130 that is typically of a fin-and-tube type is provided. In a space above the cooler 130, a cooling fan 131 is provided. The cooling fan 131 uses forced convection method to blow cool air that has been cooled by the cooler 130 into the refrigerator compartment 121, the upper freezer compartment 122, the ice-making compartment 123, the produce compartment 124, and the lower freezer compartment 125. In a space below the cooler 130, a radiant heater 132 made up of a glass tube is provided as a device for removing frost which adheres to the cooler 130 and the cooling fan 131 during the cooling.

To prevent leakage of cool air and water, a seal material such as flexible foam or the like is attached to the outer circumference of the first cooling duct 129. The lower freezer compartment 125 is separated from the produce compartment 124 by a first partition wall 133. The first partition wall 133 is filled with a foam heat insulation material 120 such as rigid urethane foam.

The refrigerator compartment 121 is separated from the upper freezer compartment 122 and the ice-making compartment 123 by a third partition wall 140. The third partition wall 140 is filled with a foam heat insulation material 120 such as rigid urethane foam. Behind the third partition wall 140, a connecting air path 150 through which cool air for cooling the refrigerator compartment 121 is conveyed is formed of a heat insulation material 137 such as expanded polystyrene is formed. The connecting air path 150 includes a single damper 139 as a damping device that adjusts a flow of cool air in the refrigerator compartment 121.

On the back of the refrigerator compartment 121, a third cooling duct 143 through which cool air is blown into the refrigerator compartment 121 is installed.

Furthermore, an air path 141 through which cool air for cooling the refrigerator compartment 121, the upper freezer compartment 122, the ice-making compartment 123, and the lower freezer compartment 125 are conveyed is provided in the first cooling duct 129. Further, a refrigerator-compartment-return-air path 142 through which the cool air from the refrigerator compartment 121 is conveyed to the produce compartment 124 is provided in the first cooling duct 129. Behind the first partition wall 133 which is filled with the foam heat insulation material 120 such as rigid urethane foam and which separates the lower freezer compartment 125 from the produce compartment 124, a connecting air path 151 formed of the heat insulation material 137 such as expanded polystyrene and the refrigerator-compartment-return-air path 142 are sealed by a seal material such as flexible foam.

Furthermore, the first cooling duct 129 includes: a discharge port 152 through which cool air is discharged into the upper freezer compartment 122; a discharge port 154 through which cool air is discharged into the ice-making compartment 123; a discharge port 147, which is for the lower freezer compartment, through which cool air is discharged into the lower freezer compartment 125; and a suction port 149 through which cool air which exchanged heat in the upper freezer compartment 122, the ice-making compartment 123, and the lower freezer compartment 125 is returned to the cooler 130.

On the back of the produce compartment 124, a discharge air path 144 and a discharge port 145 that are for the produce compartment are provided. On the bottom surface of the first partition wall 133 that is the top surface of the produce compartment 124, a suction air path 148 and a suction port 146 that are for the produce compartment are provided. A spray device 167, part of which is embedded in the first partition wall 133, is provided in the top surface of the produce compartment 124, on a centerline 171 of the produce compartment 124 in the depth direction or beyond the centerline 171. As described, the spray device 167 is provided in the produce compartment 124. From outside of the produce compartment 124, cool air flows in through the discharge port 145 that is a discharge port of cool air, and the cool air flows out to the outside of the produce compartment 124 through the suction port 146 that is a suction port of cool air. Thus, a cool air flow path is formed in the produce compartment 124, that is, cool air flown into the produce compartment 124 through the discharge port 145 mainly flows the outside of a storage container provided in the produce compartment 124 and then flows out of the produce compartment 124 through the suction port 146.

Figure 3:
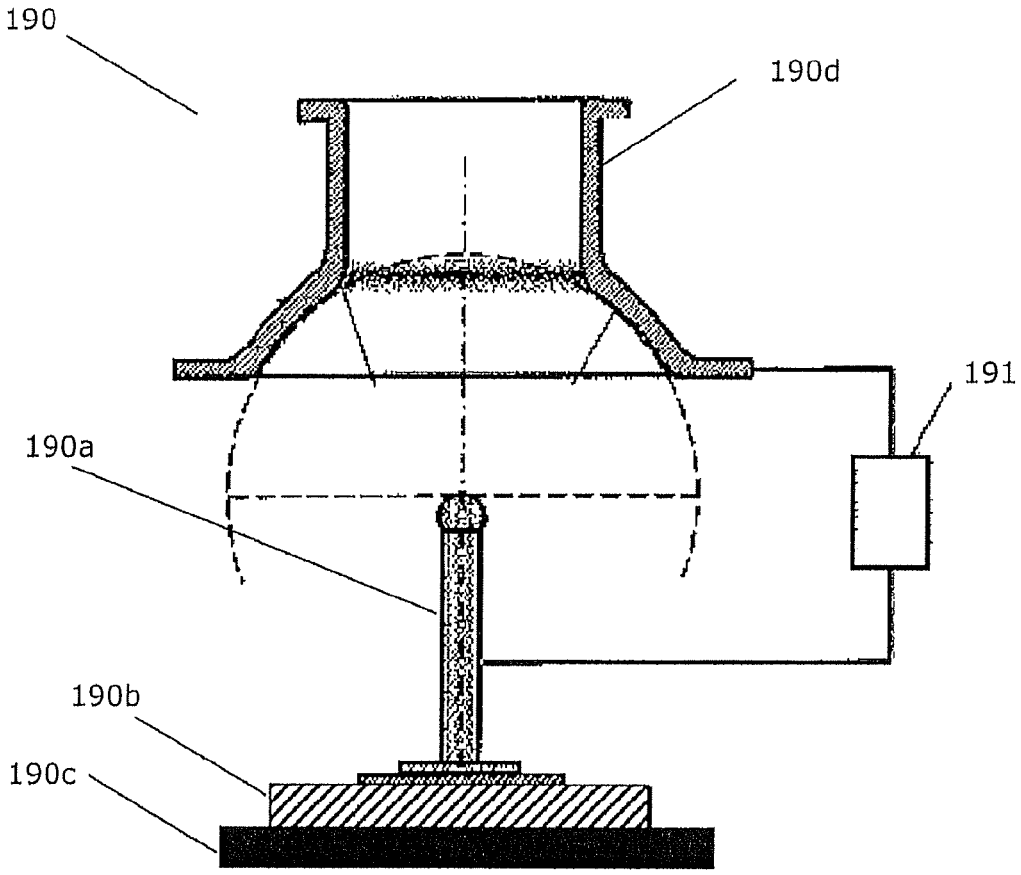
FIG. 3 is a schematic view of a mist generation device according to Embodiment 1 of the present invention.

In this Embodiment, the spray device 167 employs an electrostatic atomization method. As shown in FIG. 3, the spray device 167 includes an atomization unit 190 and a voltage application unit 191. The atomization unit 190 includes an atomization electrode 190*a* as an a tomization tip. The atomization electrode 190*a* is fixed, via an insulator 190*b* that has heat conductivity similar to the heat conductivity of alumina ceramic, to a cooling plate 190*c* as a heat transfer cooling member made of a good heat conductive member such as aluminum and stainless steel. Furthermore, on the side of the atomization electrode 190*a* opposite to the cooling plate 190*c*, a counter electrode 190*d* is disposed at a predetermined distance from the atomization electrode 190*a* on the central axis of the atomization electrode 190*a*.

The atomization electrode 190*a* is an electrode member made of a good heat conductive member such as aluminum, stainless steel, brass, and titanium. The atomization electrode 190*a* is electrically connected to the voltage application unit 191 through wire such that a predetermined voltage can be applied between the atomization electrode 190*a* and the counter electrode 190*d*.

Furthermore, an epoxy resin or the like is filled between the atomization electrode 190*a*, the insulator 190*b*, and the cooling plate 190*c*, respectively. The use of a resin which can be used to fix and suppress heat resistance such as the epoxy resin makes it possible to prevent ingress of water into the fixed portions and to maintain heat conductivity for a long time. Furthermore, to reduce the heat resistance, the atomization electrode 190*a* may be fixed to the insulator 190*b* by press fitting and the like.

It is preferable that the counter electrode 190*d* be a conductive member resistant to oxidation. For example, it is preferable that the counter electrode 190*d* be made of stainless steel. Further, it is preferable to provide surface treatment such as platinum plating. With this, long-term reliability can be improved. Especially, adhesion of foreign matter can be prevented and it is possible to prevent contamination of the surface of the counter electrode 190*d*.

Furthermore, the counter electrode 190*d* is part of dome which forms part of a sphere centered about the tip of the atomization electrode 190*a* and is in a ring shape. All positions in the inner surface of the counter electrode 190*d* maintain the same distance from the atomization electrode 190*a*.

Note that the spray device 167 provided in the produce compartment 124 is subject to a high humidity environment, and the humidity can affect the cooling plate 190*c*. Thus, it is preferable that the cooling plate 190*c* be made of a metal material which is resistant to corrosion and rust or a material which surface is coated or treated with alumite treatment or the like.

Furthermore, the cooling plate 190*c* may be shaped as a rectangular parallelepiped, a regular polyhedron, and a cylinder. The cooling plate 190*c* may be in any shape, as long as it is suitable for a structure of a portion where the cooling plate 190*c* is installed. Such polygonal shapes allow for easier positioning than the cylinder, so that the spray device 167 can be put in a proper position.

The voltage application unit 191 communicates with and is controlled by a control unit of the refrigerator main body, and switches the high voltage on or off according to an input signal from the main body of the refrigerator 101 or the spray device 167.

In this embodiment, the voltage application unit 191 is placed inside the spray device 167. Furthermore, to adapt to a low temperature and high humidity atmosphere in the produce compartment 124, a molding material or a coating material for moisture prevention is applied to a board surface of the voltage application unit 191. However, in the case where the voltage application unit 191 is placed in a high temperature part outside the storage compartment, coating is not necessary.

The front opening of the produce compartment 124, which is one of the storage compartments, is closed by a door 162 to prevent the entry of air from outside. The door 162 includes plate shaped slide rails 163 that are arranged as a pair on the right and left and extending inside the produce compartment 124. A lower storage container 164 that forms a second storage unit is placed on the slide rails 163. The lower storage container 164 forms a large storage space in the produce compartment 124. The door 162 is opened and closed by being pulled out or pushed in along the movable direction of the slide rails 163, which in turn also pulls out or pushes in the lower storage container 164. Further, on the upper side of the lower storage container 164, an upper storage container 165 that is a case which forms a first storage unit is provided. On the point of connection of each of the containers, a gap is present (gaps are present in up-down direction, front-rear direction, and left-right direction between the containers). The containers are placed in a manner such that the gaps are maintained to be as small as they can be so that each of the containers has a substantially sealed structure. Therefore, the upper storage container 165 and the lower storage container 164 move together. Here, the upper storage container 165 that is a case which forms the first storage unit is designed such that its area of the bottom surface is smaller than the area of the bottom surface of the lower storage container 164. Furthermore, air flow holes 168 are provided in a part of the upper storage container 165. In this Embodiment, the air flow holes 168 are provided on lower portion of the side walls of the upper storage container 165. Furthermore, the upper storage container 165 is disposed such that a space is provided in the lower storage container 164 on the door 162 side to allow relatively tall food items such as PET bottled beverages and tall vegetables like a Chinese cabbage to be stored in this space.

Here, the substantially sealed structure is a structure which allows sealing to a degree sufficient to maintain mist inside the upper storage container 165 at a predetermined concentration and which does not completely prevent communication of air between the inside of the upper storage container 165 and the outside.

Furthermore, in the produce compartment 124, a first sealer 180 is disposed in the top surface of the produce compartment 124, extending over the entire left-right direction of the upper front of the upper storage container 165 that forms the first storage unit under the top surface of the produce compartment 124. Furthermore, in the produce compartment 124, a second sealer 181 is disposed on the back of the produce compartment 124, extending over the entire left-right direction of the back of the lower storage container 164. The sealer 180 closes, in a state where the door 162 is closed, an upper opening that is a gap between the front of the upper storage container 165 and the first partition wall 133. Furthermore, the sealer 181 closes a gap between the back of the lower storage container 164 and the back of the upper storage container 165. With the sealers 180 and 181, the first partition wall 133, and the wall behind the lower storage container 164, the upper storage container 165 is substantially sealed.

In addition, the mist generated by the spray device 167, which is embedded in the upper storage container 165, fills the inside of the upper storage container 165 in high concentration. Therefore, by storing in the upper storage container 165 fruit and vegetables or the like that are produce of which freshness is preserved better when stored in high humidity atmosphere, the mist acts upon the fruit and vegetables or the like. Thus, it is possible to preserve freshness of the fruit and vegetables for an extended period of time and improve capability of the upper storage container 165 in preserving the freshness. Further, since the air flow holes 168 are provided on a part of the upper storage container 165, the sprayed mist that fills the inside of the upper storage container 165 passes through the air flow holes 168 and some of the mist flows into the lower storage container 164. Thus, the mist moderately acts upon the produce stored in the lower storage container 164 as well, and freshness of the produce can also be preserved for an extended period of time.

An operation and effects of the refrigerator having the above-described structure are described below.

First, flow of the cool air in the main body of the refrigerator 101 is described. The cool air blown by the cooling fan 131 is directed downward and upward through the air path 141 and conveyed. The cool air directed downward is discharged into the lower freezer compartment 125 through the discharge port 147 that is for the lower freezer compartment, exchanges heat with air inside the lower freezer compartment 125, and then returns to the cooling compartment 128 through the suction port 149.

The cool air directed upward among the cool air that is blown by the cooling fan 131 is further divided for the upper freezer compartment 122, the ice-making compartment 123, and the refrigerator compartment 121. To the upper freezer compartment 122 and the ice-making compartment 123, the cool air is discharged through the discharge port 152 and the discharge port 154, respectively. After exchanging heat, the cool air returns to the cooling compartment 128 through the suction port 149. Furthermore the cool air divided for the refrigerator compartment 121 passes through a single damper 139 disposed within the connecting air path 150, flows through the third cooling duct 143, and discharged into the refrigerator compartment 121. At this time, a signal is supplied by a control board (not illustrated) to operate the single damper 139 and thus the flow of the cool air is controlled. With this, temperature in the refrigerator compartment 121 is controlled. The temperature inside the refrigerator compartment is adjusted to a predetermined temperature.

The cool air of which temperature is increased to a certain degree by exchanging heat in the refrigerator compartment 121 flows through the refrigerator-compartment-return-air path 142, passes through the connecting air path 151 that is formed behind the first partition wall 133, and discharged into the produce compartment 124 through the discharge air path 144 and the discharge port 145 that are for the produce compartment. The cool air which exchanged heat with the air inside the produce compartment 124 is drawn into the suction port 146, flows through a suction air path 148 that is for the produce compartment, and returns to the cooling compartment 128. As seen from the above-described sequential operation, the produce compartment 124 is cooled with the cool air that is returning from the refrigerator compartment 121.

In the produce compartment 124, the first sealer 180 is disposed in the top surface of the produce compartment 124, extending over the entire left-right direction of the upper front of the upper storage container 165 under the top surface of the produce compartment 124. Furthermore, in the produce compartment 124, the second sealer 181 is disposed on the back of the produce compartment 124, extending over the entire left-right direction of the back of the lower storage container 164. Thus, in a state where the door 162 is closed, the upper opening of the upper storage container 165 is closed and, further, the back of the lower storage container 164 is closed and the substantially sealed structure is thus provided. Thus, the upper storage container 165 that is the first storage unit is disposed outside the air path of the cool air, and the direct entry of the cool air into the upper storage container 165 is suppressed. Thus, the flow of the cool air does not directly cause the flow out of the mist that fills the upper storage container 165. The upper storage container 165 is communicated with the lower storage container 164 through the air flow holes 168 and natural convection occurs with the cool air inside the lower storage container 164. The mist is gently supplied to the lower storage container 164 that is the second storage unit with the cool air. The mist concentration inside the upper storage container 165 is kept high.

Furthermore, beverages, such as those in PET bottles, are generally stored in a space in the front-rear direction of the lower storage container 164 and the upper storage container 165. This portion is directly hit by the cool air and thus stored goods can be cooled quickly. In this storage space, cool air actively blows in and out and thus this storage space has the lowest mist concentration.

As described above, (i) the produce compartment 124 includes the spray device 167 in the upper storage container 165 and the lower storage container 164 that have substantially sealed structures, and (ii) the spray device 167 is disposed on the first partition wall 133 that is the top surface of the produce compartment 124 on a centerline 171 of the produce compartment 124 in the depth direction or beyond the centerline 171.

With this, in the produce compartment, an air path of the cool air between the discharge port 145 and the suction port 146 is an outside of the upper storage container 165 that is the case which forms the first storage unit. Indirect cooling is achieved via the walls of the upper storage container 165 and the like. Meanwhile, the spray device 167 directly sprays the mist into the upper storage container 165 that has the substantially sealed structure. Thus, the mist concentration inside the upper storage container 165 that is the case can be increased.

Thus, a space having a high mist concentration can be created in a part of the produce compartment. With this, food items can be stored in a storage space where the effects of the mist is more enhanced or a storage space for general produce is stored, making it possible to select mist concentration suitable for the purpose of storage according to a type of produce or the like. Thus, it is possible to utilize the effects of the mist for produce more efficiently and to properly preserve freshness of produce.

Next, a structure of the spray device 167 is described.

The spray device 167 is disposed on the first partition wall 133 that is the top surface of the produce compartment 124 on a centerline 171 of the produce compartment 124 in the depth direction or beyond the centerline 171.

The storage space located opposite to the produce compartment 124 across the cooling plate 190*c* is the bottom of the lower freezer compartment 125. The lower freezer compartment 125 is a space which temperature is adjusted by cool air at a temperature of about −15 to −25 degrees C. that is generated by the cooler 130 by the operation of a cooling system and flown by the cooling fan 131. Thus, the cooling plate 190*c* as the heat transfer cooling member is, for example, cooled to around −10 degrees C. through the heat conduction from the bottom of the lower freezer compartment 125. Since the cooling plate 190*c* is a good heat conductive member, cold is transmitted very easily, and thus the atomization electrode 190*a* as the atomization tip is also indirectly cooled to around −5 degrees C. via the cooling plate 190*c* and the insulator 190*b*.

Here, the produce compartment 124 is at a temperature between 2 degrees C. and 7 degrees C. and is in a relatively high humidity state due to transpiration from vegetables and the like. Thus, when the atomization electrode 190*a* as the atomization tip is at dew point temperature or below, water is generated and water droplets adhere to the atomization electrode 190*a* including its tip.

The atomization electrode 190*a* to which the water droplets adhere is to be a negative voltage side, and the counter electrode 190*d* is to be a positive voltage side. Between these electrodes, a high voltage (for example, 4 to 10 kV) is applied with the voltage application unit 191. At this time, corona discharge occurs between the electrodes and thus the droplet adhering to the tip of the atomization electrode 190*a* as the atomization tip is atomized by electrostatic energy. Furthermore, since the liquid droplets are electrically charged, a charged invisible nano-level fine water vapor of a several nm level, accompanied by ozone, OH radicals, and so on, is generated by Rayleigh fission. The voltage applied between the electrodes is very high. However, a discharge current value at this time is at a several μA level, and therefore an input is very low and is about 0.5 to 1.5 W.

Here, the word "mist" described in DESCRIPTION and CLAIMS means liquid vapor of water and the like. Furthermore, the state where the liquid vapor includes at least one of ozone and OH radicals is also expressed by the word "mist". Further, the liquid vapor is sometimes described as "fine mist" when its diameter is at nano-level (a size that is to be expressed in nanometer) and at pico-level (a size that is to be expressed in picometer).

In specific, when it is assumed that the atomization electrode 190*a* is a high voltage side (−5 kV) and the counter electrode 190*d* is a reference potential side (0 V), an air insulation layer between the atomization electrode 190*a* and the counter electrode 190*d* is broken down and discharge is induced by an electrostatic force. At this time, the dew condensation water adhering to the tip of the atomization electrode 190*a* is electrically charged and becomes fine particles. Further, a fine mist is attracted to the counter electrode 190*d* and the liquid droplets are more finely divided into a charged invisible nano-level fine mist of a several nm level containing radicals. Because of the inertial force, the mist is sprayed toward the produce compartment 124.

Note that, when there is no water on the atomization electrode 190*a*, the discharge distance increases and the air insulation layer cannot be broken down, and therefore no discharge phenomenon takes place. Hence, no current flows between the atomization electrode 190*a* and the counter electrode 190*d*.

Furthermore, the atomization electrode 190*a* as the atomization tip is not directly cooled, but the cooling plate 190*c* as the heat transfer cooling member is cooled and thus the atomization electrode 190*a* can be indirectly cooled. The cooling plate 190*c* as the heat transfer cooling member is designed to have a larger heat capacity than the atomization electrode 190*a* such that the atomization electrode 190*a* can be cooled. Moreover, the cooling plate 190*c* functions as a cool storage and thus it is possible to suppress a sudden temperature fluctuation of the atomization electrode 190*a* and to realize a mist spray of a stable spray amount.

Thus, by cooling the cooling plate 190*c* as the heat transfer cooling member instead of directly cooling the atomization electrode 190*a* as the atomization tip, the atomization electrode 190*a* can be cooled indirectly. Here, since the heat transfer cooling member has a larger heat capacity than the atomization electrode 190*a*, the atomization electrode 190*a* as the atomization tip can be cooled while alleviating a direct significant influence of a temperature change of the cooling unit on the atomization electrode 190*a*. Therefore, a load fluctuation of the atomization electrode 190*a* can be suppressed, with it being possible to realize mist spray of a stable spray amount.

As described above, the counter electrode 190*d* is disposed at a position facing the atomization electrode 190*a*, and the voltage application unit 191 generates a high-voltage potential difference between the atomization electrode 190*a* and the counter electrode 190*d*. This enables an electric field near the atomization electrode 190*a* to be formed stably. As a result, an atomization phenomenon and a spray direction are determined, and accuracy of a fine mist sprayed into the storage containers (the lower storage container 164, the upper storage container 165) is enhanced, which contributes to improved accuracy of the atomization unit 190. Hence, the spray device 167 of high reliability can be provided.

Furthermore, since the counter electrode 190*d* is in a dome shape, all positions in the inner surface of the counter electrode 190*d* maintain the same distance from the atomization electrode 190*a*. With this, the direction of discharge becomes radial, and thus allowing discharging over a wide area. Thus, the amount of the fine mist can be increased. Furthermore, for example, even when a foreign matter such as dust is attached to the counter electrode 190*d*, a stable discharge state can be maintained because the discharging area is wide. Thus, it is possible to further increase the mist concentration inside the lower storage container 164 and the upper storage container 165 that are substantially sealed space provided in the produce compartment 124.

When the temperature of the atomization electrode 190*a* decreases by 1 K, a water generation speed of the tip of the atomization electrode 190*a* increases by about 10%. However, when the atomization electrode 190*a* is cooled excessively, a dew condensation speed increases sharply. This causes a large amount of dew condensation, and an increase in load of the atomization unit 190 raises concern about an input increase in the spray device 167 and freezing and an atomization failure of the atomization unit 190. According to the above-mentioned structure, on the other hand, such problems due to the load increase of the atomization unit 190 can be prevented. Since an appropriate dew condensation amount can be ensured, stable mist spray can be achieved with a low input.

Since the cooling unit can be made by such a simple structure, the atomization unit 190 of high reliability with a low incidence of troubles can be realized. Moreover, the cooling plate 190*c* as the heat transfer cooling member and the atomization electrode 190*a* as the atomization tip can be cooled by using the cooling source of the refrigeration cycle, which contributes to energy-efficient atomization.

Thus, the cooling by the cooling unit is performed from a part of the cooling plate 190*c* as the heat transfer cooling member farthest from the atomization electrode 190*a* as the atomization tip. In doing so, after the large heat capacity of the cooling plate 190*c* is cooled, the atomization electrode 190*a* is cooled by the cooling plate 190*c*. This further alleviates a direct significant influence of a temperature change of the cooling unit on the atomization electrode 190*a*, with it being possible to realize stable mist spray with a smaller load fluctuation. Furthermore, the atomization unit 190 is embedded in the top side of the produce compartment 124 that is the lowermost storage compartment in the main body of the refrigerator 101. Thus, it is difficult to reach by hand, so that safety can be improved.

Additionally, the cooling plate 190*c* as the electrode connection member has a certain level of heat capacity and is capable of lessening a response to heat conduction, so that a temperature fluctuation of the atomization electrode 190*a* as the atomization tip can be suppressed. The cooling plate 190*c* also functions as a cool storage member, thereby ensuring a dew condensation time for the atomization electrode 190*a* as the atomization tip and also preventing freezing.

Besides, by suppressing heat resistance at the connection part between the cooling plate 190*c* and the atomization electrode 190*a*, temperature fluctuations of the atomization electrode 190*a* and the cooling plate 190*c* follow each other favorably. In addition, thermal bonding can be maintained for a long time because moisture cannot enter into the connection part.

Moreover, since the produce compartment 124 is in a high humidity environment and this humidity may affect the cooling plate 190*c* as the heat transfer cooling member, the cooling plate 190*c* is made of a metal material that is resistant to corrosion and rust or a material that has been coated or surface-treated by, for example, alumite. This prevents rust and the like, suppresses an increase in surface heat resistance, and ensures stable heat conduction.

Further, when nickel plating, gold plating, or platinum plating or the like is applied to the surface of the atomization electrode 190*a* as the atomization tip, wearing of the tip of the atomization electrode 190*a* due to discharge can be suppressed. Thus, the tip of the atomization electrode 190*a* can be maintained in shape, as a result of which spray can be performed over a long period of time and also a stable liquid droplet shape at the tip can be attained.

The fine mist generated by the atomization electrode 190*a* is mainly sprayed into the upper storage container 165. The fine mist is made up of extremely small particles and so has high diffusivity. A structure which minimizes the gap in the connection part between the lower storage container 164 and the upper storage container 165 is adopted. In addition, with the first sealer 180 and the second sealer 181, the upper storage container 165 is substantially sealed. Thus, it is possible to maintain the mist concentration at a predetermined value or higher. Furthermore, since the air flow holes 168 are provided in the upper storage container 165, the fine mist reaches the lower storage container 164 as well.

The sprayed fine mist is generated by high-voltage discharge and contains OH radicals, and so is negatively charged. Meanwhile, the produce stored in the produce compartment 124 includes green leafy vegetables, fruits, and the like. Such fruit and vegetables tend to wilt more by transpiration or by transpiration during storage. Usually, some of vegetables and fruits stored in the produce compartment 124 are in a rather wilted state as a result of transpiration on the way home from shopping or transpiration during storage, and these vegetables and fruits are positively charged. Accordingly, the atomized mist tends to gather on vegetable surfaces, thereby enhancing freshness preservation.

The nano-level fine mist adhering to the vegetable surfaces contains OH radicals and also sufficiently contains ozone and the like though in a small amount. Such a nano-level fine mist is effective in sterilization, antimicrobial activity, microbial elimination, and so on, and also allows for agricultural chemical removal by oxidative decomposition and stimulates increases in nutrient of the vegetables such as vitamin C through antioxidation.

Here, when there is no water on the atomization electrode 190*a*, the discharge distance increases and the air insulation layer cannot be broken down, and therefore no discharge phenomenon takes place. Hence, no current flows between the atomization electrode 190*a* and the counter electrode 190*d*. This phenomenon may be detected by the control unit of the refrigerator 101 to control on/off of the high voltage of the voltage application unit 191.

The mist particle sprayed is, for example, about 0.005 μm to 20 μm and is extremely fine. Note that, the spray device 167 is not limited to the above. For example, a device: which uses ultrasonic to divide liquid such as water into fine particles and sprays; which uses an electrostatic atomization method; which uses a pump method to spray; and the like may adopted.

Thus, a cycle of (i) moisture evaporation from produce, (ii) dew condensation, and (iii) spray is repeated. Here, according to this embodiment, food items such as PET bottled beverages that may want to be cooled quickly are directly cooled with the discharged cool air, and food products such as leafy vegetables of which wilting may be an issue is not directly hit by the cool air in the produce compartment 124 by a substantially sealed structure and a mist is sprayed to preserve freshness. Thus, cooling according to the characteristics of food products can be performed.

At this time, although not illustrated, side walls inside the produce compartment 124 is moderately heated by a heating unit such as a heater. Thus, condensation of mist particles that are diffused to the outside of the storage container and the condensation of water that is evaporated from the vegetables do not occur.

Furthermore, the air flow holes 168 in the upper storage container 165 also serve to prevent the occurrence of excessive dew condensation in the upper storage container 165.

Furthermore, the mist is sprayed by causing an excess water vapor in the produce compartment 124 to build up dew condensation on the atomization electrode 190*a* and water droplets to adhere to the atomization electrode 190*a*. This makes it unnecessary to provide any of a defrost hose for supplying mist spray water, a purifying filter, a water supply path directly connected to tap water, a water storage tank, and so on. A water conveyance unit such as a pump is not used, either. Hence, the fine mist can be supplied to the produce compartment 124 by a simple structure, with there being no need for a complex mechanism.

Since the fine mist is supplied to the produce compartment 124 stably by a simple structure, the possibility of troubles of the refrigerator 101 can be significantly reduced. This enables the refrigerator 101 to exhibit higher quality in addition to higher reliability.

Here, since dew condensation water that is free from mineral compositions or impurities contained in tap water is used, deterioration in water retentivity caused by water retainer deterioration or clogging in the case of using a water retainer can be prevented.

Further, the atomization performed here is not ultrasonic atomization by ultrasonic vibration, with there being no need to take noise and vibration of resonance and the like associated with ultrasonic frequency oscillation into consideration.

In addition, the part accommodating the voltage application unit 191 is also cooled. Thus, it is possible to suppress a temperature increase of the board. This allows for a reduction in temperature effect in the produce compartment 124.

Note that, though ozone is generated together with the fine mist because the spray device 167 in this embodiment applies a high voltage between the atomization electrode 190*a* as the atomization tip and the counter electrode 190*d*, an ozone concentration in the produce compartment 124 can be adjusted by on/off operation control of the spray device 167. By properly adjusting the ozone concentration, deterioration such as yellowing of vegetables due to excessive ozone can be prevented, and sterilization and antimicrobial activity on vegetable surfaces can be enhanced.

In this embodiment, a high voltage (−5 kV) is applied to the atomization electrode 190*a* and a reference potential (0 V) is applied to the counter electrode 190*d* to generate a high-voltage potential difference between the electrodes. Alternatively, a high-voltage potential difference may be generated between the electrodes by setting the atomization electrode 190*a* on the reference potential side (0 V) and applying a positive potential (+5 kV) to the counter electrode 190*d*.

Furthermore, in this embodiment, a high voltage (−5 kV) is applied to the atomization electrode 190*a* and the reference potential (0 V) is applied to the counter electrode 190*d* to generate the high-voltage potential difference between the electrodes. Thus, the counter electrode 190*d* closer to the produce compartment 124 is on the reference potential side, and therefore an electric shock or the like can be avoided even when a user's hand comes near the counter electrode 190*d*. Moreover, in the case where the atomization electrode 190*a* is at the negative potential, the counter electrode 190*d* may be omitted by setting the produce compartment 124 on the reference potential side.

In such a case, for example, a conductive storage container is provided in the heat-insulated storage compartment (the produce compartment 124), where the conductive storage container is electrically connected to a holding member (conductive) of the storage container and also is made detachable from the holding member. In this structure, the holding member is connected to a reference potential part to be grounded (0 V).

This allows the potential difference to be constantly maintained between the atomization unit 190 and each of the storage container and the holding member, so that a stable electric field is generated. As a result, the mist can be sprayed stably from the atomization unit 190. Besides, since the entire storage container is at the reference potential, the sprayed mist can be diffused throughout the storage container. Further, electrostatic charges to surrounding objects can be prevented.

Thus, there is no need to particularly provide the counter electrode 190*d*, because the potential difference from the atomization electrode 190*a* can be created to spray the mist by providing the grounded holding member in a part of the produce compartment 124 side. In this way, a stable electric field can be generated by a simpler structure, thereby enabling the mist to be sprayed stably from the atomization unit.

In addition, when the holding member is attached to the storage container side, the entire storage container is at the reference potential, and therefore the sprayed mist can be diffused throughout the storage container. Further, electrostatic charges to surrounding objects can be prevented.

Though the heat source for cooling the cooling plate 190*c* as the heat transfer cooling member is the lower freezer compartment 125 in this embodiment, the ice-making compartment 123 that is one of the freezer compartments or the like may be used as the heat source. This expands an area in which the spray device 167 can be installed.

As described above, the refrigerator according to this embodiment of the present invention includes: a body which includes the produce compartment that is a storage compartment for produce; the upper storage container that is a case which defines the first storage unit provided in the produce compartment; and the spray device which sprays a mist into the upper storage container. This makes it possible to maintain the mist concentration inside the upper storage container and the mist concentration inside the produce compartment excluding the upper storage container at a different mist concentration. Therefore, it is possible to efficiently increase only the mist concentration inside the upper storage container that is a storage space, making it possible to select a mist concentration according to a purpose of storage. For example, in the upper storage container which has a high mist concentration, harmful substances attached to the produce becomes easier to rinse off.

Furthermore, with the mist generated by the electrostatic atomization method, a retention rate of sugar that changes the sweetness of fruits can be increased by increasing the thickness of the mist concentration (high mist concentration).

Figure 8:
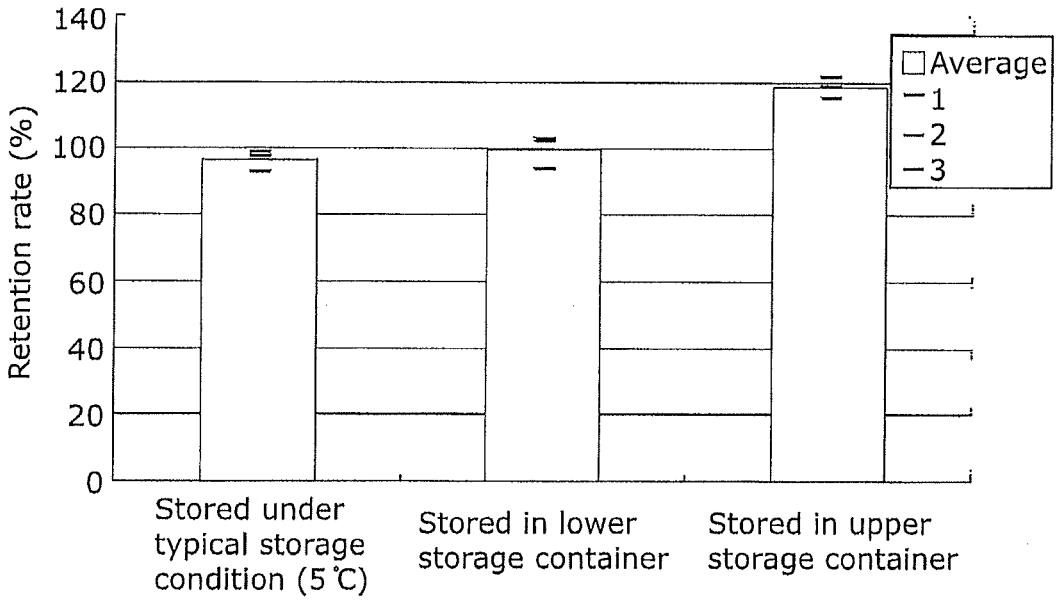
FIG. 8 is a graph showing a result of a measurement of sugar levels of strawberries.

FIG. 8 shows a result of measurement of a sugar level of strawberries as an example of fruit.

The graph shows retention rate of sugar level per unit weight of the strawberries that are stored for two days in storage units each having a different mist concentration. At this time, the mist concentration in the upper storage container is 30 μmol/L and the mist concentration in the lower storage container is 15 μmol/L.

The comparison is made as follows: stored in upper storage container indicates the case where strawberries are stored in the upper storage container that is the first storage unit having the highest mist concentration; stored in lower storage container indicates the case where strawberries are stored in the lower storage container that is the second storage unit having the mist concentration that is ½ of or lower than the mist concentration of the first storage unit; and stored under typical storage condition (5° C.) indicates the case where strawberries are stored with no mist spray.

According to the graph, compared to strawberries stored under typical storage condition (5° C.), strawberries stored in lower storage container that has low mist concentration showed a slight increase in retention rate through, there is no significant difference. In contrast, strawberries stored in upper storage container that has high mist concentration showed improvement by 22%.

As described, a storage unit having a high mist concentration is created. With this, to store food items, it is possible to select between a storage unit in which the effects of mist is more enhanced and a general storage unit.

For example, in view of the above-described results, the upper storage container as the first storage unit having a high mist concentration is used as a storage unit which mainly stores fruits. In this way, the sugar content of fruit can be increased just by storing the fruit in the refrigerator. This is practically very useful.

Furthermore, since the spray device is provided in the case which has a substantially sealed structure, and thus the mist concentration inside the case can be increased efficiently.

Furthermore, since the counter electrode is part of the dome and is in a ring shape, all positions in the inner surface of the counter electrode maintain the same distance from the atomization electrode. With this, the direction of discharge is radial, and thus allowing discharging over a wide area. Thus, the amount of fine mist can be increased. Furthermore, for example, even when a foreign matter such as dust is attached to the counter electrode, a stable discharge state can be maintained because the discharging area is wide. Thus, it is possible to further increase the mist concentration inside the upper storage container 165 that forms the first storage unit provided in the produce compartment 124.

Thus, a storage space having a high mist concentration is created in the storage compartment. With this, to store food items, it is possible to select between a storage space in which the effects of mist is more enhanced and a general storage space, making it possible to select mist concentration suitable for the purpose of storage. Thus, it is possible to utilize the effects of the mist more efficiently to preserve freshness of food items.

Furthermore, in this embodiment, the spray device is disposed in the produce compartment with portion of the spray device embedded in the top surface of the produce compartment. The lower freezer compartment cools the spray device to a temperature lower than the temperature inside the produce compartment. Thus, condensation and collection of moisture that flows between the discharge port and the suction port can be performed efficiently.

Furthermore, in this embodiment, the spray device adopts the electrostatic atomization method, and a fine mist having a particle diameter of several nanometers to several micrometers can be generated. The sprayed mist is negatively charged and thus can increase adhesion ratio of mist on vegetables, and freshness of vegetables can be preserved with a high concentration mist.

Note that, in this embodiment, the spray device may also adopt ultrasonic method. The ultrasonic method, can generate a fine mist having a particle diameter of several micrometers, and can also handle a large amount of spray. Thus, inside of the storage container can further be sufficiently humidified with the fine mist to preserve freshness of vegetables.

Embodiment 2

Figure 4:
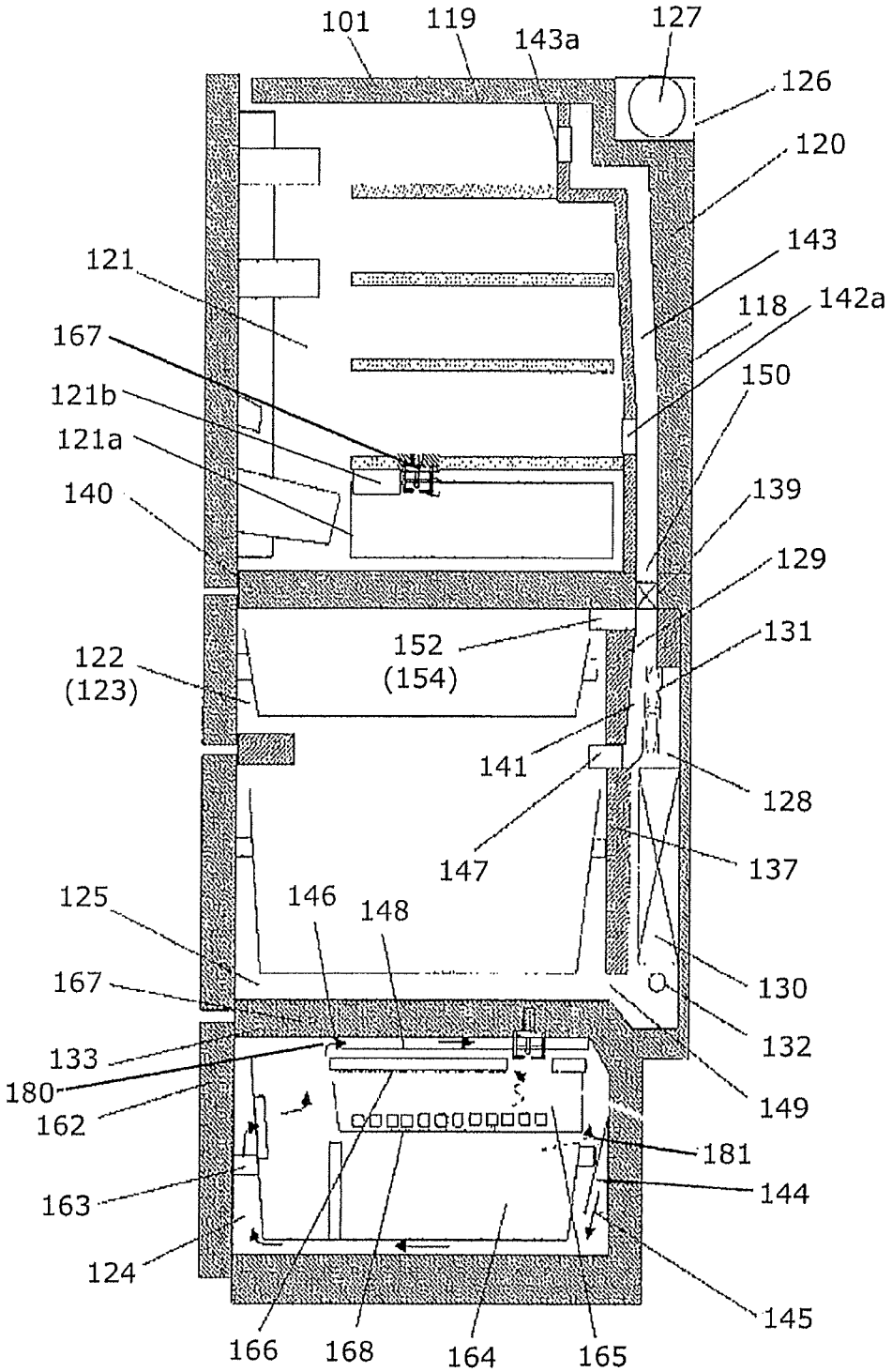
FIG. 4 is a longitudinal sectional view of a refrigerator according to Embodiment 2 of the present invention.

FIG. 4 is a longitudinal sectional view of a refrigerator according to Embodiment 2 of the present invention.

Figure 5:
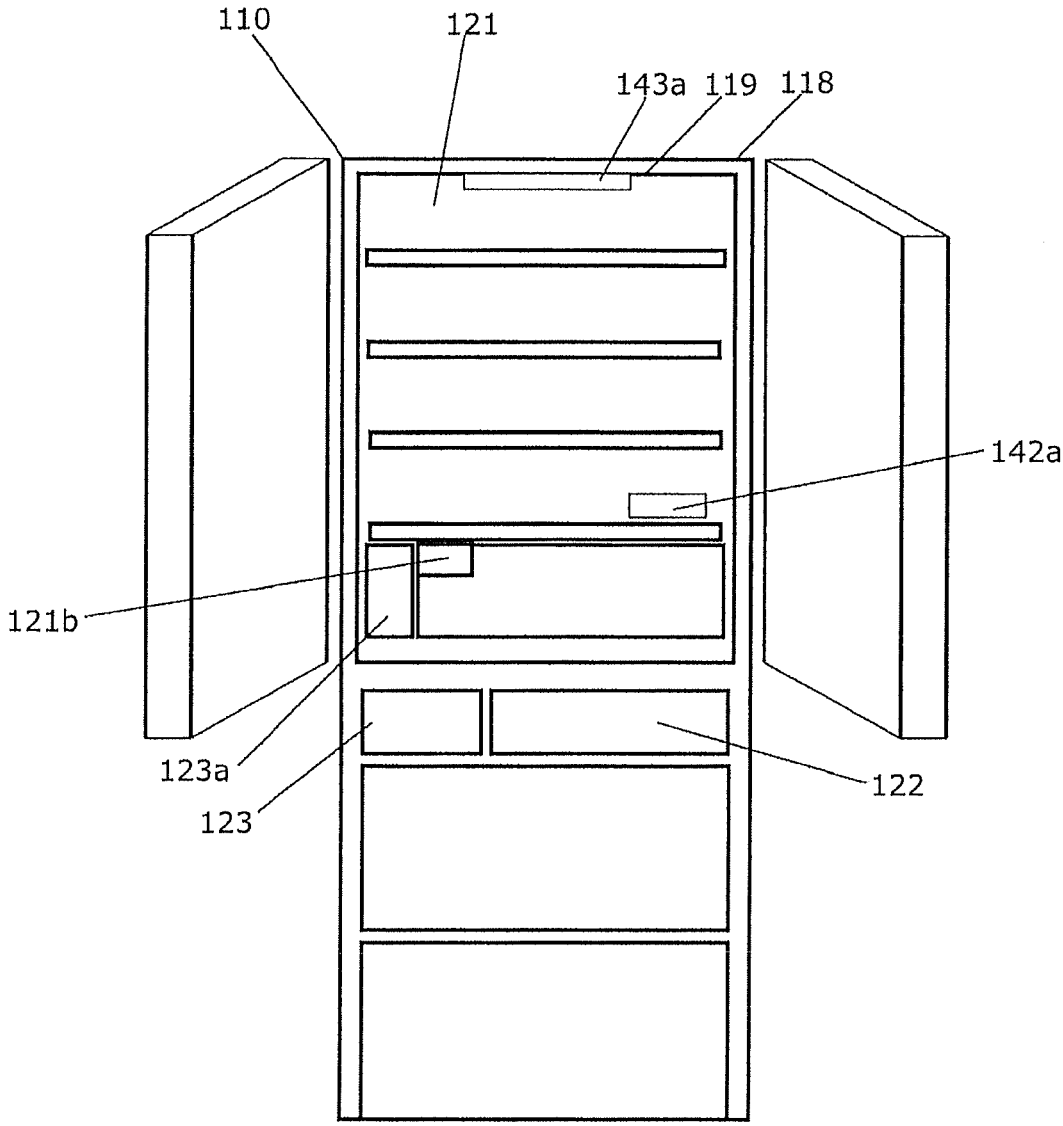
FIG. 5 is a front view of the refrigerator according to Embodiment 2 of the present invention.
Figure 6:
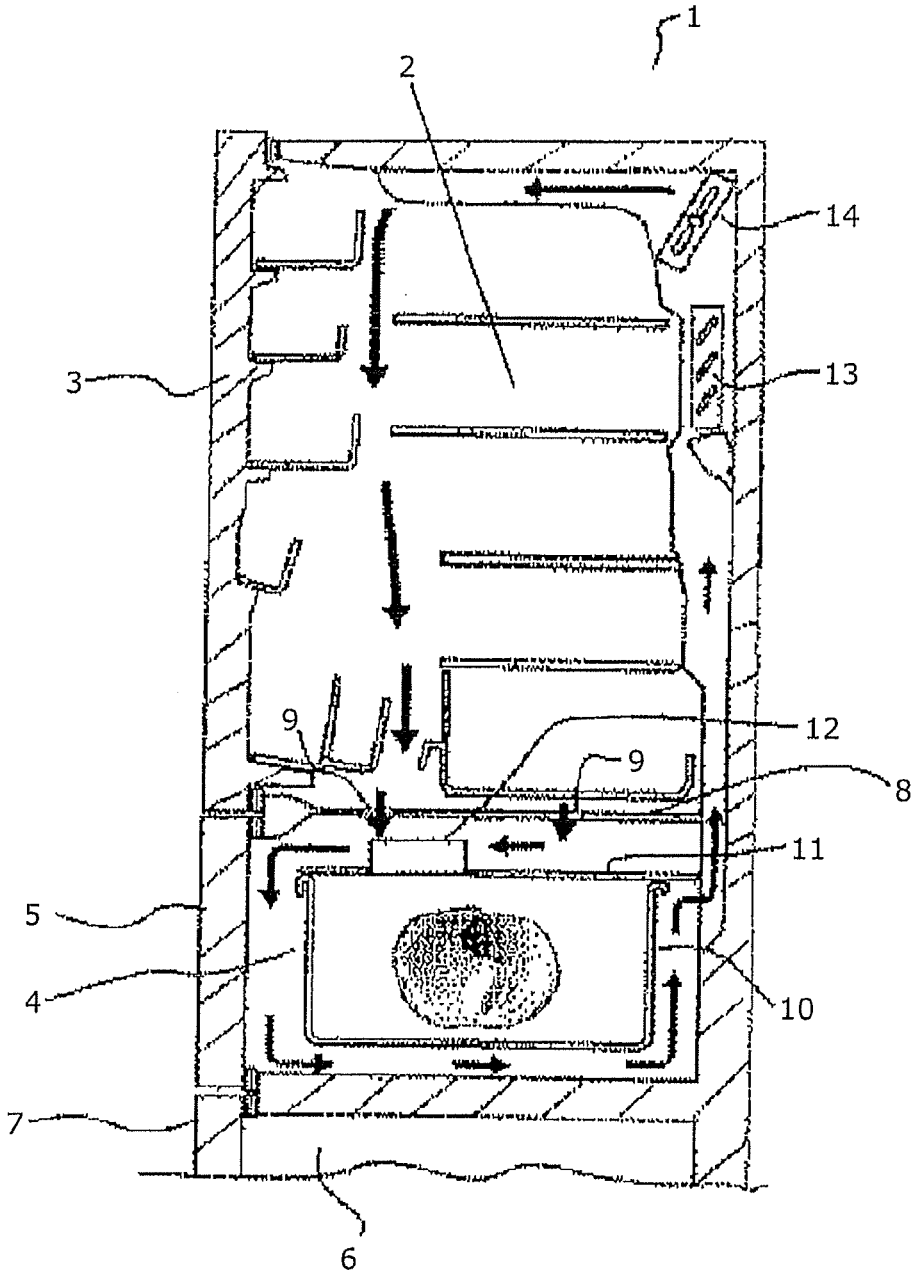
FIG. 6 is a side sectional view of a conventional refrigerator.
Figure 7:
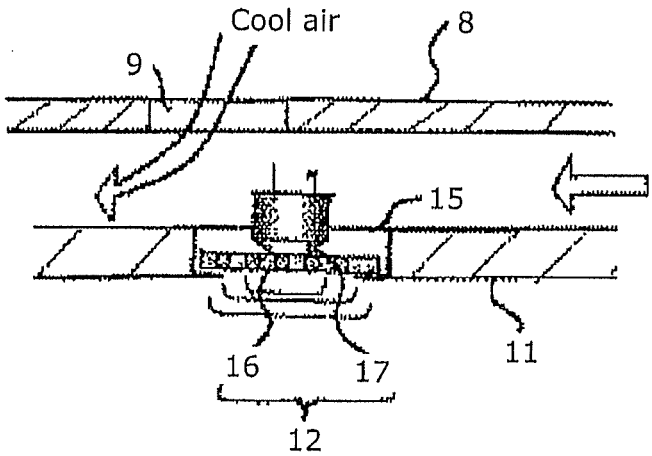
FIG. 7 is a partial cross-sectional view showing an ultrasonic humidification unit of the conventional refrigerator.

FIG. 5 is a front view of the refrigerator according to Embodiment 2 of the present invention.

Note that functions and configurations of a structure that are identical to those in Embodiment 1 shall be assigned the same reference numerals and their description shall be omitted.

In the refrigerator compartment 121 as a storage compartment, an independent storage container 121*a* that forms a first storage unit is provided as a storage space. Although small amount of cool air flows into and flow out of the independent storage container 121*a*, the independent storage container 121*a* has a substantially sealed structure. The spray device 167 is disposed in the independent storage container 121*a*. Furthermore, a mist tank 121*b* is disposed on the anterior side of the spray device. The mist tank 121*b* is a tank in which a liquid such as water can be stored. The water inside the tank is supplied to the spray device 167 and a mist is thus sprayed.

The mist tank is disposed on the anterior side of the spray device 167, and is designed to allow removal from or attachment to the anterior side without opening the independent storage container 121*a* to facilitate removal and attachment from the outside.

Furthermore, the inside of the independent storage container 121*a* can be maintained at a temperature in a temperature range different from the temperature range of the refrigerator compartment 121. For example, in addition to a temperature range for cold storage that is set between 1 degree C. and 5 degrees C. and a temperature range for produce that is set between 2 degrees C. and 7 degrees C., the independent storage container 121*a* can be set to a temperature in a range for chilled (generally between −1 degree C. and 1 degree C. or the like).

Furthermore, the heat conductivity between each of the atomization electrode 190*a*, the insulator 190*b*, and the cooling plate 190*c* needs to be maintained for a long time. Accordingly, an epoxy material or the like is poured into the connection part to prevent moisture and the like from entering, thereby suppressing heat resistance and fixing the atomization electrode 190*a*, the insulator 190*b*, and the cooling plate 190*c*. Furthermore, to reduce the heat resistance, the atomization electrode 190*a* may be fixed to the insulator 190*b* by press fitting and the like.

An operation and effects of the refrigerator having the above-described structure are described below.

The cool air directed to the refrigerator compartment 121 passes through the single damper 139 disposed within the connecting air path 150, flows through the third cooling duct 143, and discharged to the inside of the refrigerator compartment 121 via a discharge port 143*a*. In this embodiment, the discharge port 143*a* is disposed in a storage space, among storage spaces inside the refrigerator compartment 121, closest to the top surface, that is, the upper side. Here, a signal is supplied by a control board (not illustrated) to operate the single damper 139 and thus the flow of the cool air is controlled. With this, temperature in the refrigerator compartment 121 is controlled. The temperature inside the refrigerator compartment is adjusted to a predetermined temperature.

In the refrigerator compartment 121, a cool air path is formed by the cool air discharged from the discharge port 143*a* which flows downward and then flows into a cool air suction port 142*a*. The independent storage container 121*a* that forms the first storage unit is provided in an area outside the cool air path, and the spray device 167 is disposed in the independent storage container 121*a*. With this, a mist concentration inside the independent storage container 121*a* that forms the first storage unit becomes high. Although the mist flows out to a storage space outside the independent storage container 121*a*, the mist concentration outside the independent storage container 121*a* is low.

Thus, a space having a high mist concentration can be created in the refrigerator compartment 121 that is a storage compartment. With this, to store food items, it is possible to select between a storage space in which the effects of mist is more enhanced and a general storage space, making it possible to select mist concentration suitable for the purpose of storage. Thus, it is possible to utilize the effects of the mist more efficiently to preserve freshness of food items.

Furthermore, in this embodiment, mist spray is performed using water that is stored in the mist tank 121*b*. Thus, a required amount of mist can be appropriately sprayed.

Furthermore, the mist tank 121*b* is disposed on the anterior side of the spray device 167, and is designed to allow removal from or attachment to the anterior side without opening the independent storage container 121*a* to facilitate removal and attachment from the outside, and thus it is easy to supply water to the mist tank 121*b*.

Furthermore, by providing on the anterior side of the spray device 167 the mist tank 121*b*, it is possible to discourage users from directly touching the spray device 167 and to realize a structure which is safer.

In this case, a control unit performs control such that the spray device 167 does not operate, i.e. the spray device 167 stops operation, with the mist tank 121*b* removed. Thus, even if users touch the spray device 167 in a state where the mist tank is removed, the spray device 167 is in a stopped state in which high voltage is not flowing. Thus, sufficient safety is ensured.

Furthermore, with the electrostatic atomization method as in this embodiment, a nano-size fine mist is sprayed from the atomization electrode 190*a* by applying a high voltage. There is a possibility that the high voltage causes the mist tank 121*b* to be electrically charged, the charged current flows to a user, and the user feels a tingling sensation when removing or attaching the mist tank. To prevent this trouble, an antistatic means is provided to the mist tank 121*b* so that the mist tank 121*b* does not become electrically charged.

Specifically, for example, the antistatic means can be provided by forming the mist tank 121*b* with an antistatic material. With this, it is possible to prevent the portion where the user touches from getting charged. In addition, it is also possible to prevent the charging of the mist tank by grounding the mist tank 121*b*.

In the case where the above-described antistatic means is adopted, it is possible to more completely prevent the portion which is touched by the user from getting charged, by providing to the independent storage container 121*a* that forms the first storage unit the antistatic means. With this, the refrigerator of high quality can be provided.

In the refrigerator compartment 121, different from the above-described produce compartment 124 in which the spray device 167 is provided with dew condensation water, the spray device 167 is provided with water stored in the mist tank 121*b* via a water absorbent material and thus the cooling plate 190*c* does not have to be provided.

Thus, in the independent storage container 121*a* that forms the first storage unit in which the mist concentration is increased as in this embodiment, effects such as sterilization, antimicrobial activity, and microbial elimination are achieved. Moreover, on produce such as vegetables, useful effects can be realized efficiently such as agricultural chemical removal by oxidative decomposition and increase in nutrient such as vitamin C through antioxidation.

As described above, according to this embodiment, the spray device 167 is provided in the independent storage container 121*a* that has a substantially sealed structure and thus the mist concentration inside the independent storage container 121*a* can be efficiently increased.

Furthermore, since a liquid stored in the mist tank 121*b* is sprayed, a liquid such as water that is added with a functional medicine, such as water added with vitamin C, can be sprayed. Thus, it is also possible to create in the independent storage container 121*a* an environment that is suitable for preserving produce and food items.

Note that the dew condensation water generation means is not limited to the cooling plate method that utilizes the cool air in the refrigerator. It is also possible to adopt a Peltier method and actively cause dew condensation water to be generated in a chilled compartment that is a low humidity environment to improve efficiency in mist generation.

[Industrial Applicability]

As described above, a refrigerator according to the present invention can preserve freshness of produce by efficiently collecting moisture given off by produce that are stored and re-sprays the moisture. Therefore, the present invention is applicable not only to a household refrigerator but also to an industrial refrigerator, food storage, and a refrigerator truck.

REFERENCE SIGNS LIST

101 refrigerator
112 cooler
113 cooling fan
118 outer case
119 inner case
120 foam heat insulation material
121 refrigerator compartment
121*a* independent storage container
121*b* mist tank
122 upper freezer compartment
123 ice-making compartment
124 produce compartment
125 lower freezer compartment
126 machinery chamber
127 compressor
128 cooling compartment
129 first cooling duct
130 cooler
131 cooling fan
132 radiant heater
133 first partition wall
136 counter electrode
137 heat insulation material
139 single damper
140 third partition wall
141 air path
142 refrigerator-compartment-return-air path
143 third cooling duct
143*a* discharge port
144 discharge air path
145 discharge port
146 suction port
147 discharge port
148 suction air path
149 suction port
152 discharge port
154 discharge port
162 door (produce compartment)
163 slide rail
164 lower storage container (produce compartment)
165 upper storage container (produce compartment)
166 lid
167 spray device
168 air flow hole
169 mist spray port
171 centerline (in the depth direction)
180 first sealer
181 second sealer
190 atomization unit
190*a* atomization electrode
190*b* insulator
190*c* cooling plate
190*d* counter electrode
191 voltage application unit

The invention claimed is:

1. A refrigerator comprising:

a storage compartment which can be set to a temperature range suitable for storing produce;

a first storage unit and a second storage unit which are provided in said storage compartment;

a spray device which sprays a mist into said first storage unit so that said first storage unit has a higher mist concentration than said second storage unit;

a first sealer which closes, in a state where a door is closed, an entire gap at an upper portion of a front of said first storage unit in a left-right direction; and a second sealer which closes, in the state where the door is closed, an entire gap between said storage compartment and a back of said second storage unit in a left-right direction.

2. The refrigerator according to claim 1, further comprising a cooling compartment which includes a cooler that generates cool air, wherein said storage compartment includes:

a discharge port through which the cool air is discharged into said storage compartment; and a suction port through which the cool air is returned to said cooling compartment, and said first storage unit is disposed outside an air path through which the cool air flows from said discharge port to said suction port.

3. The refrigerator according to claim 1, wherein the mist contains at least one of ozone and OH radicals.

4. The refrigerator according to claim 1, wherein said first storage unit is defined by a case that has a substantially sealed structure.

5. The refrigerator according to claim 1, wherein said spray device is disposed on a centerline of said storage compartment in an up-down direction or above the centerline of said storage compartment in the up-down direction.

6. The refrigerator according to claim 4, wherein said first and second sealers are soft.

7. The refrigerator according to claim 4, wherein said case has a shape of an open-topped box, and said refrigerator further comprises a lid that covers the top of the case.

8. The refrigerator according to claim 1, further comprising a freezer compartment that is disposed with a partition wall having heat insulation properties interposed between said freezer compartment and said storage compartment, said freezer compartment being kept at a temperature lower than a temperature of said storage compartment, wherein said spray device is embedded in the partition wall.

9. The refrigerator according to claim 1, wherein a first bottom surface of said first storage unit is disposed above a second bottom surface of said second storage unit.

10. The refrigerator according to claim 9, wherein said first storage unit includes a plurality of air flow holes such that said first storage unit and said second storage unit are in fluid communication to allow said mist to move from said first storage unit to said second storage unit.

11. The refrigerator according to claim 9, wherein said first bottom surface of said first storage unit has a smaller area than said second bottom surface of said second storage unit.

12. The refrigerator according to claim 2, wherein said discharge port is disposed below said second sealer.

* * * * *